US006558277B1

(12) United States Patent
Ohira et al.

(10) Patent No.: US 6,558,277 B1
(45) Date of Patent: May 6, 2003

(54) GOLF BALL WITH COLOR FLOP MARKING

(75) Inventors: Takashi Ohira, Chichibu (JP); Hisako Nakahama, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/522,841

(22) Filed: Mar. 10, 2000

(30) Foreign Application Priority Data

Mar. 11, 1999 (JP) ..... 11-064334

(51) Int. Cl.[7] ..... A63B 37/12; A63B 37/14; A63B 37/04; A63B 37/06; G09F 3/00

(52) U.S. Cl. ..... 473/378; 473/371; 40/327

(58) Field of Search ..... 473/351, 361, 473/364, 365, 367, 368, 370, 371, 373, 374, 376, 377, 378; 40/327

(56) References Cited

U.S. PATENT DOCUMENTS 3,647,221 A * 3/1972 Holley ..... 473/376
5,669,831 A * 9/1997 Lutz ..... 473/377
5,762,573 A * 6/1998 Kennedy, III et al. ..... 473/570
5,770,325 A * 6/1998 Keller et al. ..... 428/914
5,785,612 A * 7/1998 Shapiro et al. ..... 473/377
5,823,890 A * 10/1998 Maruko et al. ..... 473/354
6,019,921 A * 2/2000 Lutz ..... 264/129
6,022,279 A * 2/2000 Yamagishi et al. ..... 473/353
6,120,394 A * 9/2000 Kametani ..... 473/378

FOREIGN PATENT DOCUMENTS

JP 53-63137 6/1978 ..... A63B/37/14

OTHER PUBLICATIONS

Callister, Jr., William D. Materials Science and Engineering: An Introduction, Fourth Edition. New York: John wiley & Sons, Inc. 1997, p. 489.*
Merriam–Webster's Dictionary (www.m–w.com).*
Callister, Jr., William D., Materials Science and Engineering: An Introduction, 4th Edition., New York: John Wiley & Sons, Inc., copyright 1997, pp. 499–501.*

* cited by examiner

*Primary Examiner*—Paul T. Sewell
*Assistant Examiner*—ALvin A. Hunter, Jr.
(74) *Attorney, Agent, or Firm*—Sughrue Mion, PLLC

(57) ABSTRACT

On a golf ball surface, a marking layer is formed from an ink having a lightness of up to 60 based on the Lab color space, and a transparent or translucent layer containing a pigment having an optical interference effect and capable of selectively reflecting and transmitting light is formed on the marking layer. The golf ball has the unique marking entailing the color flop effect that the color appearance varies over the iridescent spectrum with the viewing angle.

9 Claims, 2 Drawing Sheets

GOLF BALL WITH COLOR FLOP MARKING

This invention relates to a golf ball bearing a unique marking, and more particularly, to a golf ball bearing a marking having the "color flop effect" that the color appearance varies with the viewing angle.

BACKGROUND OF THE INVENTION

In general, golf balls are provided on their surface with markings in single or multiple colors representing letters, numerals, trade names and logos.

The markings on golf balls are conventionally applied by various methods including a direct printing method such as pad printing, and a transfer method of stamping a wholly inked transfer film with a marking press. Also employed is a heat transfer printing method using a transfer film in the form of a base film on which a transfer ink layer is formed in a desired pattern as disclosed in JP-A 53-63137.

The inks for use in these ma usually printing inks which are prepared by mixing an ink medium (which is prepared as a transparent or translucent ink intermediate adequate for the printing purpose) with an organic or inorganic pigment. These inks develop a color by the mechanism that light of specific wavelength is absorbed by the pigment and the remaining light is reflected or transmitted.

As the golfer population increases and golfers' taste diversify, there arises in the golf ball market a desire to develop a golf ball which is discriminable from competitive manufacturers' balls. A particular attention is paid to the marking on the ball surface since the marking governs the ball appearance and is attractive to the eyes. It is strongly desired to modify, tailor and improve the marking. Offering a golf ball with a more appealing marking will encourage customers' purchase and contribute to further activation of the market.

However, the prior art inks used in the marking of golf balls are limited in that only their color hue is tailored by changing the blend proportion of pigments, failing to meet the market demand for fulfilling diverse needs of individual customers.

SUMMARY OF THE INVENTION

Therefore, an object of the invention is to provide a golf ball with a unique marking having the color flop effect such that the color appearance varies with the viewing angle and thus presenting an attractive appearance which has never been achieved in the prior art.

The invention provides a golf ball having a ball surface. A marking layer is formed on the ball surface from an ink having a lightness of up to 60 based on the Lab color space. A transparent or translucent layer containing a pigment having an optical interference effect and capable of selectively reflecting and transmitting light is formed on the marking layer. Preferably, the pigment is composed mainly of a liquid crystal and has a structure that liquid crystal molecules are stacked in plural layers with different aligned directions and bound with a transparent resin.

In one embodiment, the transparent or translucent layer encloses the entire ball surface on which the marking layer has been formed. In another embodiment, the transparent or translucent layer encloses only the marking layer. Preferably, the transparent or translucent layer is formed by coating a paint comprising the pigment or by injection molding a thermoplastic resin having the pigment compounded therein, or by printing an ink having the pigment compounded therein. Another pigment or a dye or both may be added to the transparent or translucent layer in such an amount as not to impair the transparency thereof.

Preferably, the ball surface has been at least partially colored to a lightness of up to 60 based on the Lab color space before the formation of the transparent or translucent layer.

According to the invention, the golf ball is formed on its ball surface with a marking layer of an ink having a lightness of up to 60 based on the Lab color space, and further thereon with a transparent or translucent layer containing a pigment having an optical interference effect and capable of selectively reflecting and transmitting light. Most often, the marking layer encloses a localized portion of the ball surface. Preferably the pigment is composed mainly of a liquid crystal and has a structure that liquid crystal molecules are stacked in plural layers with different aligned directions therebetween and bound with a transparent resin. Then the ball is given a characteristic outer appearance entailing the unique color effect that light directed to the ball surface undergoes interactions between the transparent or translucent layer containing the specific pigment and the underlying marking layer so that the color appearance continuously changes over the iridescent color spectrum as the viewing angle is changed while the mark stands out in relief.

In one preferred embodiment, the ball surface is 25 partially or entirely colored to a lightness of up to 60 based on the Lab color space before the formation of the transparent or translucent layer. Then a portion or the entirety of the ball surface other than the marking layer is also given a characteristic color flop effect, enhancing the appearance.

Since the golf ball of the invention has a characteristic outer appearance with the unique color flop effect, the marking helps the golf ball look more attractive and discriminable from competitive manufacturers' golf balls when the customer purchases the golf ball after comparison by actually viewing several balls in hand.

DESCRIPTION OF THE PREFERRED EMBODIMENTS

First Embodiment

Figure 1:
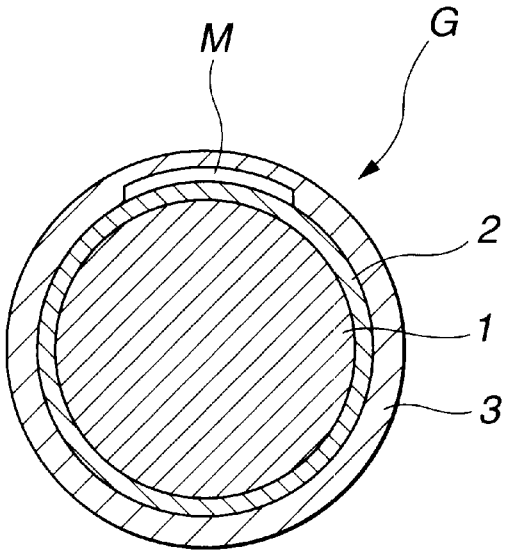
FIG. 1 is a schematic cross-sectional view of a golf ball according to a first embodiment of the invention.

Referring to FIG. 1, there is illustrated in cross section a golf ball according to a first embodiment of the invention. The golf ball G is a two-piece solid golf ball having a core 1 enclosed with a cover 2. The ball has a substantially spherical shape or cover surface which is formed with a multiplicity of dimples though not shown.

The golf ball G on its cover surface is marked with an ink having a lightness of up to 60 based on the Lab color space, to form a marking layer M. The marking layer M accounts for a localized region of the cover surface in the illustrated embodiment. On the entire ball surface including the marking layer M, there is formed a transparent or translucent layer 3 which contains a pigment having an optical interference effect and capable of selectively reflecting and transmitting light. It is noted that the transparent or translucent layer 3 has such transparency that the mark in the marking layer can be fully distinguished and recognized. In this sense, the transparent or translucent layer 3 may be, of course, transparent/colorless and even be transparent/colored to such an extent that the objects of the invention are not impaired.

The marking layer M is formed of an ink having a lightness (L value) of up to 60, preferably up to 40 based on the Lab color space, and especially a black ink having such a lightness. If an ink having a higher lightness, especially an ink of pale color is used, the marking layer reflects almost all the light transmitted by the overlying layer that is the transparent or translucent layer 3, restraining the light interference, selective reflection and transmission in the overlying layer, failing to provide a color flop effect. On the other hand, if an ink having a lower lightness, especially an ink of black color is used, the marking layer absorbs almost all the light transmitted by the overlying layer, allowing the light interference, selective reflection and transmission in the overlying layer to develop a significant influence, enhancing the color development and color change. This is advantageous for the color flop effect to develop.

It is noted that the Lab color space is expressed by the following equations using tristimulus values X, Y and Z as prescribed in JIS Z 8701.

$$L=10Y^{1/2} \quad (1)$$

$$a=17.5(1.02X-Y)/Y^{1/2} \quad (2)$$

$$b=7.0(Y-0.847Z)/Y^{1/2} \quad (3)$$

In the equations, X, Y and Z are tristimulus values in XYZ system on a perfect diffuse reflection surface.

In the Lab color space, L stands for a lightness that represents whether a perceived color is light or dark, that is, a degree of brightness. Larger values of L indicate brighter color. Letters a and b represent color in red-green direction and yellow-blue direction, respectively. Larger values of a indicate more reddish color whereas smaller values of a indicate more greenish color. Larger values of b indicate more yellowish color whereas smaller values of b indicate more bluish color.

The ink used for the marking purpose is prepared by mixing a suitable amount of a pigment or dye as a coloring agent with an ink medium (which is prepared as a transparent or translucent ink intermediate adequate for the printing purpose) such that the lightness based on the Lab color space is not more than 60.

The pigment or dye used herein may be selected from those employed in customary paints and inks. The pigment may be either organic or inorganic and examples thereof include carbon black, graphite, iron black, red lead, red iron oxide, ultramarine, Prussian blue, Lithol Red B, Brilliant Scarlet G, Pigment Scarlet 3B, Brilliant Carmine 6B, Lake Red C, Lake Red D, Permanent Red 4R, Bordeaux 5B, Bordeaux 10B, Para Red, Watchung Red, Benzidine Orange, BON Maroon L, BON Maroon M, Brilliant Scarlet, Vermillion Red, Phthalocyanine Blue, Phthalocyanine Green, Fast Sky Blue, Aniline Black, zinc white, white lead, chrome yellow, zinc yellow, disazo yellow, barium sulfate, Fast Yellow G, and Fast Yellow 10G. These pigments may be used alone or in admixture of two or more.

Examples of the dye include Acid Yellow, Acid Orange, Acid Red, Acid Blue, Acid Green, Acid Brown, Acid Black, Solvent Yellow, Solvent Orange, Solvent Red, Solvent Blue, Solvent Black, and Solvent Green. These dyes may be used alone or in admixture of two or more.

The marking method may be any of customary methods employed in the marking of golf balls. Included are a direct printing method such as pad printing, a transfer method of stamping a wholly inked transfer film with a marking press, and a heat transfer printing method. The type, position and number of marks to be marked are not critical. Any desired mark selected from letters, numerals, trade name, and logo may be applied at any desired position on the ball surface.

For protecting the marking layer M (or the mark) on the ball surface and imparting a color flop effect, a transparent or translucent layer 3 which contains a pigment having an optical interference effect and capable of selectively reflecting and transmitting light is formed on the marking layer M.

The transparent or translucent layer may overlie the entire ball surface on which the marking layer has been formed or only the marking layer. In the first embodiment illustrated herein, the transparent or translucent layer overlies the entire ball surface.

The pigment in the transparent or translucent layer should have an ability to provide optical interference and to selectively reflect and transmit light. This ability is given particularly when the pigment is composed mainly of a liquid crystal and has a special structure that liquid crystal molecules are stacked in plural layers with different aligned directions and bound with a transparent resin.

More illustratively, the special structure of the pigment is established by the liquid crystal as the base component in that cigar-shaped molecules consisting of a siloxane skeleton originating from silicon and organic side chain groups are extended parallel and arranged in parallel layers, and these parallel layers are stacked such that the molecular orientation may shift little by little between adjacent layers, thereby forming a blood platelet structure, namely a rightward or leftward twisted helical structure. This structure is fixedly bound by polymerization reaction of a transparent resin (e.g., UV-curable resin).

By virtue of the above-described special structure, the pigment of the invention has an ability to provide optical interference and to selectively reflect and transmit light. The ability to selectively reflect and transmit light means that visible light is little absorbed, but selectively reflected and transmitted by the respective parallel layers at differing angles so that a color flop effect entailing a continuous color tone change is achieved. The optical interference effect means that light of all colors excluding the reflected color is propagated and transmitted whereupon the pigment or dye constructing the marks in the underlying layer (marking layer) absorbs and reflects the light to achieve interaction with the overlying layer (transparent or translucent layer). These effects cooperate to provide the color flop effect that a continuous color change occurs over the iridescent color spectrum as the viewing angle is changed, so that the mark stands out in relief. This creates a characteristic outer appearance having the unique color effect which has never been achieved heretofore.

The pigments having the above-mentioned abilities are commercially available, for example, under the trade name of HELICONE 624, HELICONE 450, HELICONE 515, and HELICONE 575 from Wacker-Chemie GmbH. These pigments allow only a specific wavelength (color) to be selectively reflected and transmitted When the undercoat (marking layer) is black, HELICONE 450 provides a continuous color flop from blue to dark color, HELICONE 515 provides a continuous color flop from green to blue, HELICONE 575 provides a continuous color flop from golden to bluish green, and HELICONE 624 provides a continuous color flop from bronze to green.

In the first embodiment, a transparent or translucent layer containing the pigment having an ability to provide optical interference and to selectively reflect and transmit light is formed on the entire ball surface preferably by (1) a coating method of applying a paint comprising a base paint and the pigment or (2) a molding method of injection molding a resin compound comprising a base resin and the pigment.

With respect to the coating method (1), the base paint is preferably selected from transparent paints such as clear paints commonly used in the surface painting of golf balls. Examples include two-part curing type urethane paints (based on the crosslinking reaction of polyols such as acrylic polyols, polyester polyols and polycarbonate polyols with isocyanates), aqueous emulsion paints (e.g., polyester urethane resin paints), and UV-curing type acrylic paints.

Preferably 2 to 15 parts, more preferably 5 to 10 parts, and most preferably 5 to 8 parts by weight of the pigment having an ability to provide optical interference and to selectively reflect and transmit light is added to 100 parts by weight of the base paint. With a less amount of the pigment, the influence of the undercoat (marking layer) may become greater. An excessive amount of the pigment may exacerbate the transmission and propagation of light, detracting from the color flop effect.

With respect to the molding method (2), the base resin may be selected from transparent thermoplastic resins commonly used as the cover of golf balls, typically ionomer resins which are commercially available under the trade name of Himilan from Dupont-Mitsui Polychemical K.K. and Surlyn from Dupont.

Preferably 0.1 to 10 parts, more preferably 0.5 to 2 parts by weight of the pigment having an ability to provide optical interference and to selectively reflect and transmit light is added to 100 parts by weight of the base resin. With a less amount of the pigment, the influence of the undercoat (marking layer) may become greater. An excessive amount of the pigment may exacerbate the transmission and propagation of light, detracting from the color flop effect.

Apart from the pigment having an ability to provide optical interference and to selectively reflect and transmit light, it is recommended to add a UV absorber, photostabilizer and other suitable additives to the paint or resin compound for the transparent or translucent layer for the purpose of preventing discoloration of the layer by light irradiation. Such additives may be added in amounts of 0.1 to 5 parts, preferably 0.5 to 3 parts by weight per 100 parts by weight of the base paint or base resin.

Another pigment or a dye or both may added to the transparent or translucent layer in such an amount as not to impair the transparency thereof, that is, in such an amount that the mark in the marking layer can be fully distinguished and recognized. This enables the addition of a desired color to the color flop effect, achieving a wider spectrum of unique appearance. The other pigment or dye used herein may be selected from those commonly used in customary paints and inks, for examples, the pigments and dyes exemplified above for the marking layer.

As the coating method using the above-described paint, any method commonly used for the surface painting of golf balls may be employed, for example, brush coating, spray coating and electrostatic coating. The paint is preferably coated to a thickness of 5 to 50 $\mu$m, more preferably 10 to 30 $\mu$m.

As the molding method using the pigmented resin compound, an injection molding method using a mold for the cover of conventional golf balls may be employed. The coating preferably has a thickness of about 0.5 to about 3 mm. This coating plays the role of a cover too.

Since a marking layer is formed on the ball surface from an ink having a lightness of up to 60 based on the Lab color space and the entire ball surface including the localized marking layer is coated with a paint containing a pigment having an ability to provide optical interference and to selectively reflect and transmit light, the golf ball according to the first embodiment of the invention has the advantage that the mark in the marking layer looks with the unique color flop effect that the color changes with a varying angle of viewing while the mark stands out in relief. The golf ball is given a characteristic outer appearance which has never been achieved heretofore.

In general, the golf ball surface is painted white or covered with a cover resin having a white pigment compounded therein so that the surface is rendered white to a high lightness (typically L value of at least 90). Then, even after the entire ball surface is further coated with a paint containing a pigment having an ability to provide optical interference and to selectively reflect and transmit light, the white ball surface reflects almost all of the light transmitted by the pigmented paint coating. Then no color flop effect occurs except for the marking portion. If the ball surface is partially or entirely colored with a color paint of red, yellow, green or blue having a lightness of up to 60, preferably up to 40, based on the Lab color space, and this colored ball surface is further coated with a paint or resin containing a pigment having an ability to provide optical interference and to selectively reflect and transmit light, then the color flop effect is additionally imparted to the part or entirety of the ball surface other than the marking portion. A further characteristic outer appearance is created in this way.

Second Embodiment

Figure 2:
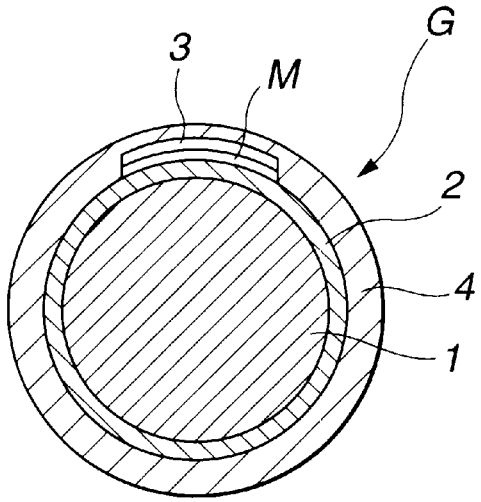
FIG. 2 is a schematic cross-sectional view of a golf ball according to a second embodiment of the invention.

Referring to FIG. 2, there is illustrated in cross section a golf ball according to a second embodiment of the invention. The golf ball G has the same basic structure as in the first embodiment.

The golf ball G on its cover surface is formed with a marking layer M using an ink having a lightness of up to 60 based on the Lab color space. The marking layer M accounts for a localized region of the cover surface in the illustrated embodiment. A transparent or translucent layer 3 is formed only on the marking layer M using an ink containing a pigment having an ability to provide optical interference and to selectively reflect and transmit light. On the entire ball surface, a surface coating 4 is formed. In the second embodiment, both the marking layer and the transparent or translucent layer are localized ones.

In the golf ball of the second embodiment, the ink having a lightness of up to 60 based on the Lab color space as used for marking and the pigment having an ability to provide optical interference and to selectively reflect and transmit light are the same as in the first embodiment.

The ink used in forming the transparent or translucent layer 3 may be prepared by adding to a base resin the pigment having an ability to provide optical interference and to selectively reflect and transmit light. The base resin used herein may be selected from urethane resins, acrylic resins, polyester resins, and vinyl chloride-vinyl acetate copolymers commonly used in inks.

In the ink, preferably 30 to 80 parts, more preferably 40 to 60 parts by weight of the pigment having an ability to provide optical interference and to selectively reflect and transmit light is added to 100 parts by weight of the base resin. A less amount of the pigment may fail to exert its effect. An excessive amount of the pigment may impede printing and exacerbate the transmission and propagation of light, detracting from the color flop effect.

In the second embodiment, the marking layer M and the transparent or translucent layer 3 may be formed by any desired method. Ink printing techniques are advantageous because only a localized region (to be marked) can be coated. Among others, a pad printing method and a transfer film method are adequate.

In the pad printing method, an ink pattern corresponding to a desired mark is once transferred from a block copy to a pad, then transferred to a golf ball surface to form a marking layer M. Thereafter, using an ink containing a pigment having an ability to provide optical interference and to selectively reflect and transmit light, a transparent or translucent layer 3 is formed only on the marking layer M by a similar pad printing method.

Figure 3:
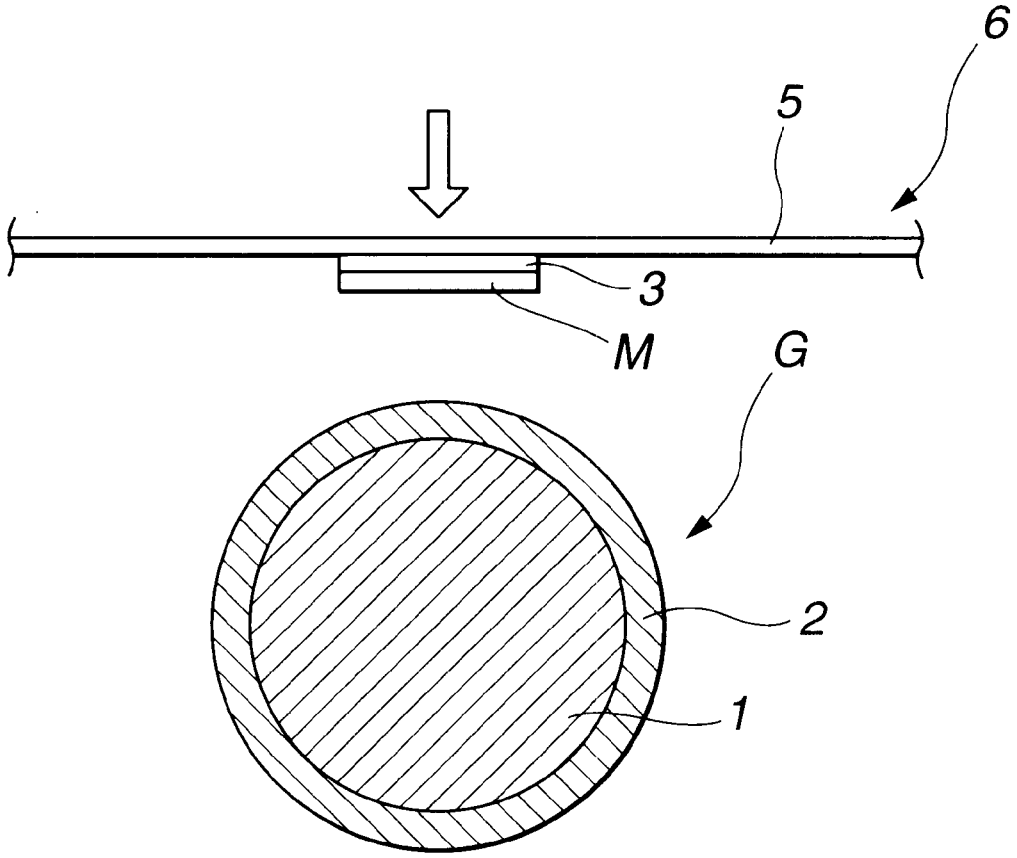
FIG. 3 illustrates a marking method using a transfer film.

Referring to FIG. 3, the marking method using a transfer film is described. On a polypropylene web 5, a transparent or translucent layer 3 is formed from an ink containing a pigment having an ability to provide optical interference and to selectively reflect and transmit light, and a marking layer M is formed thereon from an ink having a lightness of up to 60 on the Lab color space. This results in a transfer film 6. The transfer film 6 is placed close to the golf ball G such that the marking layer M faces the ball surface. Using a transfer pad, heat and pressure is applied to the transfer film 6 from its rear side (from above in the figure) whereby the marking layer M and the transparent or translucent layer 3 are simultaneously transferred to the ball surface.

The marking method using a transfer film has the advantage that both the marking layer M and the transparent or translucent layer 3 can be effectively formed on the ball surface by a single transfer operation. The heat and pressure conditions are not critical and may follow the usual marking on golf balls using transfer film. The transparent or translucent layer 3 preferably has a thickness of 1 to 8 $\mu$m, and more preferably 2 to 5 $\mu$m. In a too thin transparent or translucent layer, the pigment may be unevenly distributed. Too thick a transparent or translucent layer may render the marking portion less durable and tend to be damaged as by rubbing due to a longer drying time.

The paint for forming a surface coating on the ball surface after marking may be selected from transparent paints such as clear paints commonly used in the surface painting of golf balls.

In the second embodiment, the transparent or translucent layer can be formed only on the marking layer by a simple means using an ink containing a pigment having an ability to provide optical interference and to selectively reflect and transmit light. Then the characteristic color flop effect is imparted to only the marking portion. This gives economical and productivity advantages.

As long as the golf ball of the invention is provided on the ball surface with a unique marking having a color flop effect, no particular limits are imposed on the structure, material and manufacturing process of the golf ball. Using well-known materials, the golf ball can be manufactured by conventional processes. The golf balls may be either wound golf balls or two- or multi-piece solid golf balls.

The unique marking according to the invention is applicable not only to golf balls, but also for the painting and marking on shafts of tennis rackets and golf clubs and the decoration of golf ball boxes.

EXAMPLE

Examples 1–4 & Comparative Examples 1–2

Two-piece solid golf balls were prepared by molding a solid core having a diameter of 37.90 mm from a well-known material in a conventional manner and forming around the core a cover of ionomer resin to a thickness of 2.4 mm.

On the golf ball surface, a mark was printed by a pad printing method using L type black ink from Tampo K.K. (Examples 1–4 and Comparative Example 2). A mark was similarly printed using L type white ink from Tampo K.K. (Comparative Example 1).

Paints for Examples 1–4 and Comparative Examples 1–2 were prepared by mixing paint components in a proportion as shown in Table 1. These paints were sprayed onto the marked ball surfaces of Examples 1–4 and Comparative Examples 1–2 to form a uniform paint coating having an average thickness of 15 $\mu$m.

The painted golf balls were examined for color flop effect and UV stability by the following tests. The results are also shown in Table 1.

Color Flop Effect

The mark on the golf ball was visually observed at different viewing angles to examine how the color appearance flopped.

Good: good color flop

Fair: fair color flop

No: no color flop

UV Stability

The ball was exposed to light from a mercury lamp for 24 hours. The change of color of the clear paint coating before and after light exposure was measured using a color difference meter model MSC-IS-2DH (Suga Tester K.K.). Based on the Lab color space of JIS Z 8701, the color difference ΔE of the clear paint coating before and after light exposure was determined. Note that a smaller color difference ΔE indicates a less change in color of the clear paint coating.

TABLE 1

| | EX1 | EX2 | EX3 | EX4 | CE1 | CE2 |
|---|---|---|---|---|---|---|
| Clear paint*1 | 100 | 100 | 100 | 100 | 100 | 100 |
| Pigment*2 | 2 | 5 | 10 | 20 | 10 | 10 |
| UV absorber*3 | 2 | 2 | 2 | 2 | 2 | 0 |
| Light absorber*4 | 2 | 2 | 2 | 2 | 2 | 0 |
| Color flop | Good | Good | Good | Fair | No | Good |
| Color difference ΔE | 4.7 | 4.7 | 4.7 | 4.7 | 4.7 | 12.7 |

*1A two-part curing type urethane clear paint was prepared by blending a polyol and a polyisocyanate so as to give a molar ratio of hydroxyl to isocyanate group (OH/NCO) equal to 1/1, and adding a thinner thereto for adjusting to a non-volatile content of about 37%.
polyester polyol: Desmorphen 670–80 (Sumitomo-Bayer Urethane K.K.), OH value = 135
polyisocyanate: Sumidur N-75 (Sumitomo-Bayer Urethane K.K.), NCO = 16.5%
*2HELICONE 624 (Wacker-Chemie GmbH)
*3Tinuvin 400 (Ciba Specialty Chemicals)
*4Tinuvin 292 (Ciba Specialty Chemicals)

As seen from Table 1, the ball of Comparative Example 1 does exhibit no color flop effect because of marking with a white ink having a higher lightness. The ball of Comparative Example 2 exhibits a good color flop effect, but undergoes a substantial discoloration of the clear paint coating upon light exposure because of the lack of UV absorber and light absorber.

By contrast, the balls of Experimental Examples 1 to 3 exhibit a good color flop effect and undergo little discoloration of the clear paint coating upon light exposure. The ball of Experimental Example 4 is rather inferior in color flop effect because a large amount (20 parts by weight) of the pigment obstructs the transmission and propagation of light so that the paint coating is whitish over its entirety.

The golf ball of the invention has a unique marking entailing the color flop effect that the color appearance changes over the iridescent spectrum at different viewing angles. The ball is endowed with a characteristic outer appearance.

Japanese Patent Application No. 11-064334 is incorporated herein by reference.

Reasonable modifications and variations are possible from the foregoing disclosure without departing from either the spirit or scope of the present invention as defined by the claims.

What is claimed is:

1. A golf ball having a ball surface, wherein a marking layer is formed on the ball surface from an ink having a lightness of up to 60 based on the Lab color space, and a transparent or translucent layer, containing a pigment having an optical interference effect and capable of selectively reflecting and transmitting light, is formed on the marking layer, said pigment being composed mainly of a liquid crystal and having a structure wherein liquid crystal molecules are stacked in plural layers aligned in different directions and bound with a transparent resin.

2. The golf ball of claim 1 wherein the transparent or translucent layer encloses the entire ball surface on which the marking layer has been formed.

3. The golf ball of claim 1 wherein the transparent or translucent layer encloses only the marking layer.

4. The golf ball of claim 1 wherein the transparent or translucent layer is formed by coating a paint comprising the pigment.

5. The golf ball of claim 1 wherein the transparent or translucent layer is formed by injection molding a thermoplastic resin having the pigment compounded therein.

6. The golf ball of claim 1 wherein the transparent or translucent layer is formed by printing an ink having the pigment compounded therein.

7. The golf ball of claim 1 wherein another pigment or a dye or both are added to the transparent or translucent layer in such an amount as not to impair the transparency thereof.

8. The golf ball of claim 1 wherein before the formation of the transparent or translucent layer, the ball surface has been at least partially colored to a lightness of up to 60 based on the Lab color space.

9. A golf ball having a ball surface, wherein a marking layer is formed on the ball surface from an ink having a lightness of up to about 60 based on the Lab color space, and a transparent or translucent layer, containing a pigment of less than 15 parts by weight to 100 parts by weight of a base paint or base resin having an optical interference effect and capable of selectively reflecting and transmitting light, is formed on the marking layer.

* * * * *